US009683371B1

(12) United States Patent
Nitch

(10) Patent No.: US 9,683,371 B1
(45) Date of Patent: Jun. 20, 2017

(54) GUTTER GUARD

(71) Applicant: Stephen J. Nitch, Cary, NC (US)

(72) Inventor: Stephen J. Nitch, Cary, NC (US)

( * ) Notice: Subject to any disclaimer, the term of this patent is extended or adjusted under 35 U.S.C. 154(b) by 0 days.

(21) Appl. No.: 14/949,398

(22) Filed: Nov. 23, 2015

(51) Int. Cl.
*E04D 13/076* (2006.01)
*E04D 13/064* (2006.01)
*E04D 13/068* (2006.01)

(52) U.S. Cl.
CPC ..... *E04D 13/076* (2013.01); *E04D 13/064* (2013.01); *E04D 13/068* (2013.01); *E04D 13/0641* (2013.01)

(58) Field of Classification Search
CPC ... E04D 13/06; E04D 13/0641; E04D 13/068; E04D 13/076; E04D 13/04; E04D 13/064
USPC ..... 52/11, 12, 15
See application file for complete search history.

(56) References Cited

U.S. PATENT DOCUMENTS 1,526,821 A * 2/1925 Andrews ..... E04D 13/076 210/477
2,023,452 A * 12/1935 Voegeli ..... E04C 2/292 52/378
2,209,741 A * 7/1940 Sullivan ..... E04D 13/076 210/474
2,284,440 A * 5/1942 Morrissey ..... E04D 13/076 52/12
2,423,923 A * 7/1947 Audino ..... E04D 13/076 210/474
2,542,155 A * 2/1951 Moller ..... E04D 13/076 52/12
2,569,568 A * 10/1951 Lipshaw ..... E04D 13/076 210/474
2,810,173 A * 10/1957 Bearden ..... E04D 13/076 108/33
4,745,710 A * 5/1988 Davis ..... E04D 13/076 210/473
5,257,482 A * 11/1993 Sichel ..... E04D 13/076 52/12
5,321,920 A * 6/1994 Sichel ..... E04D 13/076 52/12
5,495,694 A * 3/1996 Kuhns ..... E04D 13/076 52/11
6,067,755 A * 5/2000 Maanum ..... E04D 13/076 248/48.1
6,164,020 A * 12/2000 Nitch ..... E04D 13/076 52/11
6,951,077 B1 10/2005 Higginbotham
7,056,433 B2 6/2006 Swistun
7,064,271 B1 6/2006 Gretz
8,397,435 B2 3/2013 Iannelli
2001/0037610 A1 11/2001 Davis
2001/0100223 8/2002 Brochu
2005/0028452 A1 2/2005 Brochu
(Continued)

*Primary Examiner* — Adriana Figueroa
*Assistant Examiner* — Jessie Fonseca
(74) *Attorney, Agent, or Firm* — Charles F. Meroni, Jr.; Meroni & Meroni, PC

(57) ABSTRACT

A gutter screen contemplating a first slip joint and a second slip joint located at a second end of the gutter screen and matable to the first slip joint, the first slip joint being a descending step-stair design; and the second slip joint being an extended beveled edge, the beveled edge matable to each step of the first slip joint such that when pressure is applied the extended beveled edge will ascend the step-stair, and when pressure is reduced the extended beveled edge will descend the step-stair.

21 Claims, 5 Drawing Sheets

(56) References Cited

U.S. PATENT DOCUMENTS

| | | | | |
|---|---|---|---|---|
| 2005/0102909 | A1* | 5/2005 | Carpenter | E04D 13/076 52/11 |
| 2007/0214731 | A1* | 9/2007 | Bachman | E04D 13/076 52/12 |
| 2008/0120921 | A1 | 5/2008 | McDonald et al. | |
| 2011/0265391 | A1 | 11/2011 | Robins | |
| 2012/0110922 | A1 | 5/2012 | Hawes | |
| 2012/0110923 | A1 | 5/2012 | Robins | |
| 2012/0186163 | A1 | 7/2012 | Walker | |
| 2012/0192502 | A1 | 8/2012 | Glander | |
| 2013/0061537 | A1 | 3/2013 | Hawes | |
| 2013/0091780 | A1* | 4/2013 | Robins | E04D 13/076 52/12 |
| 2013/0248672 | A1* | 9/2013 | Martin | E04D 13/076 248/312.1 |
| 2013/0326846 | A1 | 12/2013 | Cullen | |
| 2015/0033638 | A1 | 2/2015 | Davis | |
| 2015/0089883 | A1 | 4/2015 | Peck et al. | |
| 2016/0201329 | A1* | 7/2016 | Ianelli | E04D 13/072 52/12 |

* cited by examiner

GUTTER GUARD

BACKGROUND OF THE INVENTION

Field of the Invention

The present invention generally relates to an improved gutter guard assembly and joints. More particularly, the present invention relates a screen-type gutter guard with interlocking joints designed to control and account for thermal expansion of the gutter guard during cold and/or hot weather.

Discussion of the Prior Art

U.S. Pat. No. 6,164,020 ('020 Patent), which issued to Nitch, discloses a Roof Gutter Guard. The '020 Patent describes a gutter screen for preventing the accumulation of debris within a gutter is disclosed. The gutter screen has a plurality of ribs positioned to run transversely across the gutter. Each rib has a rounded first top section, the first top section having a top surface emanating circumferentially about the first top section, a V-shaped first bottom section, a first end, and a second end. The gutter screen also has a plurality of bars positioned to ran above and generally parallel to the gutter. The bars have a rounded second top section and a V-shaped second bottom section. The second top section of each bar is attached to and interconnects the first bottom sections of each rib, the ribs and the bars defining a plurality of gutter screen apertures. A roof flange for attaching the gutter screen underneath a roof shingle extends from the first end of each rib. The roof flange has a roof flange surface which is flush with the top surface of the rib. A L-shaped gutter flange for engaging a gutter edge extends transversely and interconnectingly across each rib just below the first top section at the second end of each rib.

U.S. Pat. No. 6,951,077 ('077 Patent), which issued to Higginbotham, discloses a Non Clogging Screen. The '077 Patent essentially describes an improved gutter shield device includes a first connecting plane of roll formed metal, a second filtering plane of roll formed metal and metallic or polymer cloth, and a third connecting plane of roll formed metal combined into an integral unit. An elongated strip of roll formed metal includes a rear vertical plane adapted to seat beneath shingles of a roof structure. The rear vertical plane is crimped by roll forming onto the second and rear longitudinal edge of a forward extending plane that combines a fine filtering membrane with an underlying skeletal support of expanded metal as an integral unit. The expanded metal and filtering membrane so joined contain two or more v-shaped downward extending longitudinal channels within the forward extending plane that transverse the length of the forward extending plane parallel to it's first edge. The forward extending plane is bound on a first and forward longitudinal edge by a first plane of that comprises a roll formed angled z-shaped connecting metal strip for securing the gutter shield to an inwardly extending flange of a k-style gutter.

U.S. Pat. No. 7,056,433 ('433 Patent), which issued to Swistun, discloses a Gutter Screen Termination Trim with Water Tension Breaker. The '433 Patent describes a gutter screen attachment for minimizing water film runoff and debris collection adjacent a screened gutter. The screen attachment comprises a superior breaker edge, an inferior breaker edge, and a screen-receiving region. The screen-receiving region comprises an edge-receiving fold that accepts the gutter-engaging edge of a gutter screen. The superior breaker edge extends upwardly opposite the inferior breaker edge and is designed to break the water tension of a water film formed upon the gutter screen. The inferior breaker edge is designed to prevent water leakage between the screen attachment and the gutter. The superior breaker edge is of minimized height so as to allow bulky debris to translate over the superior breaker edge. It is thus contemplated that the superior breaker edge functions to allow water to more properly permeate through the gutter screen.

United States Patent Application No. 2005/0028452, which was authored by Brochu, describes a device for protecting a gutter having a rear wall, front wall and a bottom wall, the walls defining a trough there between, the device comprising a guard member having generally planar central portion with one side thereof having an inverted U-shaped configuration designed to fit over an upper marginal edge of the rear wall of the gutter while at the other side, there is provided an overflow wall. The guard and gutter are attached directly to a supporting structure by means of screws or other mechanical fastening devices.

United States Patent Application No. 2013/0061537, which was authored by Hawes, relates to an apparatus that prevents rain gutters for clogging and, more particularly, a gutter guard.

United States Patent Application No. 2015/0033638, which was authored by Davis, describes gutter guard apparatuses and methods of making the same are provided. A gutter guard apparatus for preventing debris from entering rainwater collection gutters on a structure. A gutter guard apparatus can comprise a guard panel and mesh layer that cooperate to prevent debris from entering a rainwater collection gutter. The mesh layer can be secured to the guard panel at substantially all points of contact between the mesh layer and guard panel to thereby provide a secure and durable gutter guard apparatus. Methods and devices for forming a gutter guard can comprise bonding the mesh layer to a guard panel using a radiant heater, heated roller, adhesive applicator, ultrasonic welder and/or combinations thereof.

SUMMARY OF THE INVENTION

Gutter screens have been previously used in order to prevent the accumulation of leaves, sticks, and other debris in a gutter while allowing for the flow of rainwater into the gutter. However, the prior art gutter screens routinely encounter the problems of allowing too much debris into the gutter and/or allowing too little water into the gutter (often known as spillover). In addition, prior art screens become ineffective over time as they are unable to prevent accumulation of leaves and debris in the gutter screen thus losing efficacy and resulting in increased, unwanted, spillover. Accordingly, it is an object of this invention to provide a gutter screen that minimizes the amount of debris that will clog the gutters and the gutter screen itself thus maximizing desired water flow into the gutter.

In addition, gutters and gutter screens have routinely encountered the problem of thermal expansion. Previously, gutter screens have been installed end-to-end by aligning them on top of the gutter, typically heavily relying on the expertise of the installer. However, ambient temperature changes affect the expansion/contraction of the gutter screen material after installation of the screen. Therefore, during cooler weather the guards need spacing between each section or they will bind and warp as temperatures rise and fluctuate. Conversely, if gutter screens are installed during hotter weather, the contraction of the material will result in significant gaps between the guards resulting in significant debris entering, and eventually clogging the gutter, significantly impeding the intended purpose of the gutter guard.

Accordingly it is an object of this invention to provide a gutter screen capable of being installed at any temperature, minimize installation error, simplify the installation process, and minimize damage to the gutters caused by negligent installation of gutter screens.

To achieve these objectives, a gutter screen for compensating for thermal expansion and/or contraction and preventing the accumulation of debris within a gutter is proposed.

In one embodiment the invention considers a gutter screen having at least a plurality of bars positioned to run above and generally parallel to a gutter, each bar having a rounded top section and a V-shaped bottom section, a plurality of ribs positioned to run transversely across and above the gutter, each having a first end and a second end; each rib having a rounded top section and a V-shaped bottom section, the ribs positioned on top of the bars to define a plurality of apertures for water penetration therein, a roof flange for attaching the gutter screen to a roof, the roof flange extending laterally from the first end of each rib, interconnecting each rib, the roof flange having a top surface flush to the top section of each rib, an L-shaped gutter flange for engaged a gutter edge, the gutter flange extending laterally from the second end of each rib, interconnecting each rib, a plurality of oval screw holes located on the gutter flange, a first slip joint located at a first end of the gutter screen, a second slip joint located at a second end of the gutter screen and matable to the first slip joint, the first slip joint being a descending step-stair design, each step having a beveled edge, the second slip joint being an extended beveled edge, the beveled edge matable to each of the beveled edges each step of the first slip joint such that when pressure is applied the extended beveled edge will ascend the step-stair, and when pressure is reduced the extended beveled edge will descend the step-stair. The step stairs may preferably be equipped with visual indicators indicating the proper way to install the gutter screen at various temperatures.

In another embodiment, the invention considers a gutter screen having at least a plurality of bars positioned to run above and generally parallel to a gutter, a plurality of ribs positioned to run transversely across and above the gutter, the ribs positioned on top of the bars to define a plurality of apertures for water penetration therein, a first end of the plurality of ribs positioned nearest an edge of a roof, a first slip joint located at a first end of the gutter screen, a second slip joint located at a second end of the gutter screen and matable to the first slip joint, the first slip joint being a descending step-stair design, each step having a beveled edge, and the second slip joint being an extended beveled edge, the beveled edge matable to each of the beveled edges each step of the first slip joint such that when pressure is applied the extended beveled edge will ascend the step-stair, and when pressure is reduced the extended beveled edge will descend the step-stair. The embodiment may preferably be capable of accounting for thermal expansion of the gutter screen material.

In another embodiment, the invention considers a method of installing a gutter screen the method having at least the steps of providing a plurality of gutter screen portions, said gutter screen portions comprising a plurality of bars positioned to run above and generally parallel to a gutter, a plurality of ribs having a first end and a second end positioned to run transversely across and above the gutter, the ribs positioned on top of the bars to define a plurality of apertures for water penetration therein, a first slip joint located at a first end of the gutter screen, a second slip joint located at a second end of the gutter screen and matable to the first slip joint, the first slip joint being a descending step-stair design, each step having a beveled edge, the second slip joint being an extended beveled edge, the beveled edge matable to each of the beveled edges each step of the first slip joint such that when pressure is applied the extended beveled edge will ascend the step-stair, and when pressure is reduced the extended beveled edge will descend the step-stair, a roof flange for attaching the gutter screen to a roof, the roof flange extending laterally from the first end of each rib, interconnecting each rib, the roof flange having a top surface flush to the top section of each rib, and an L-shaped gutter flange for engaged a gutter edge, the gutter flange extending laterally from the second end of each rib, interconnecting each rib, positioning a first gutter screen portion above a gutter, the gutter mounted to the side of a building and having a gutter edge; the roof flange positioned nearest the building and the gutter flange positioned nearest the gutter edge, positioning a second gutter screen portion adjacent to the first gutter screen portion, mating the first slip joint of the first gutter screen portion to the second slip joint of the second gutter screen portion and thereby assembling the gutter screen.

The aforementioned method may be further modified and specifically include at least the steps of obtaining a reading of the ambient temperature during installation of the gutter screen, wherein each step of the first slip joint is labeled with a temperature indicator, and wherein mating the first slip joint of the first gutter screen portion to the second slip joint of the second gutter screen portion comprises aligning the extended beveled edge of the second slip joint with the step of the first slip joint having the temperature indicator closest to the reading of the ambient temperature.

Such embodiments do not represent the full scope of the invention. Reference is made therefore to the claims herein for interpreting the full scope of the invention. Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of the following brief descriptions of drawings.

DETAILED DESCRIPTION OF THE PREFERRED EMBODIMENT

Figure 1:
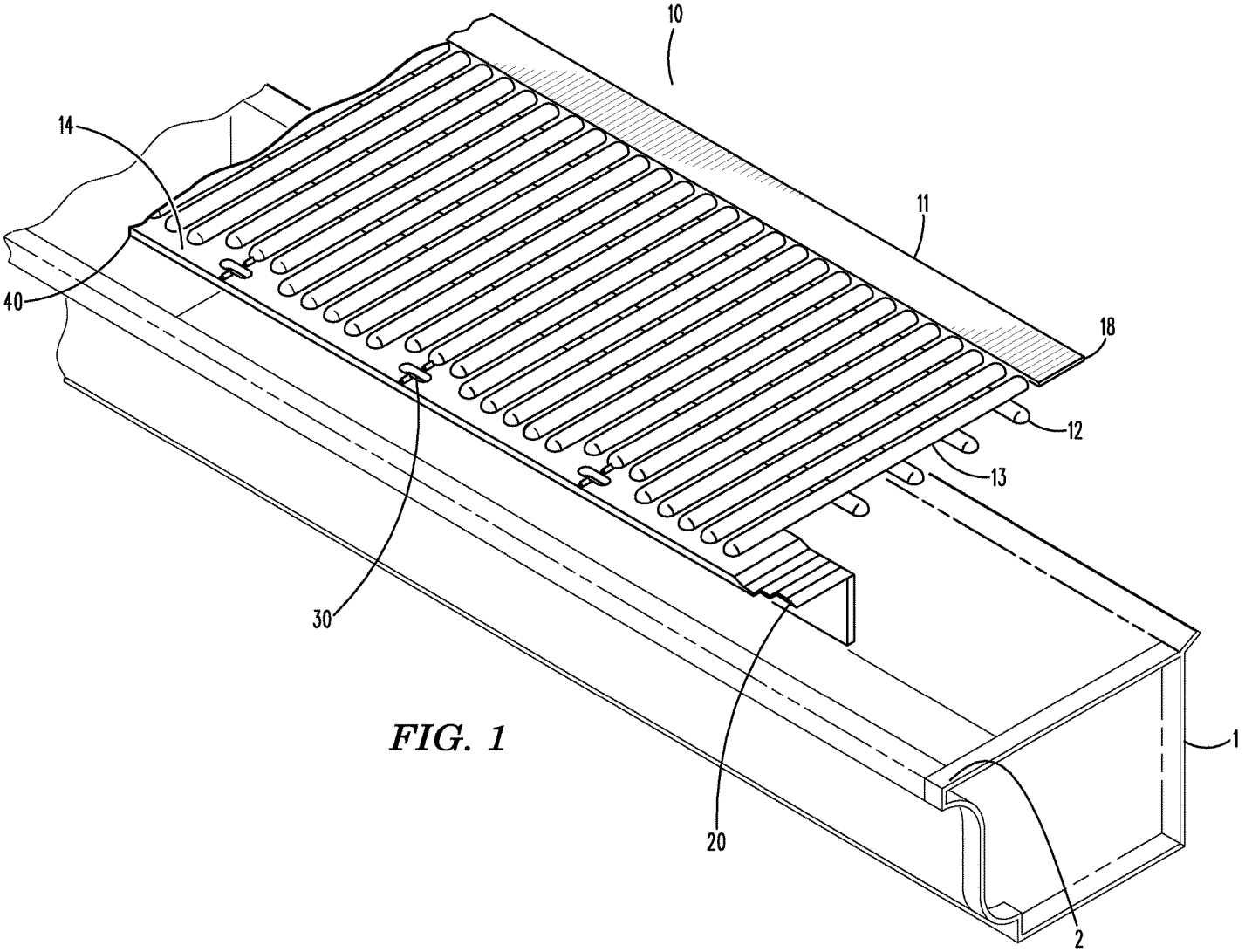
FIG. 1 is a perspective view of a preferred gutter screen or gutter guard assembly and gutter.

Referring now the drawings with more specificity, the present invention essentially provides a gutter screen or gutter guard as at 10 which is preferably formed as a three dimensional construction and that can be easily constructed and deconstructed by hand or other similar means and is mountable on a commercial or residential gutter 1. The gutter screen 10, according to the present invention, preferably comprises a roof flange 11 for attaching the gutter screen 10 to a roof or similar structure, a plurality of bars 12 that run generally in parallel with the gutter 1 when installed, a plurality of ribs 13 that cross, generally perpendicularly to the bars 12, and an L-shaped gutter flange 14.

The gutter screen 10 is preferably constructed from any number of moldable flexible synthetic plastic material. Such moldable materials may be provided with select coloration to comport with the user's needs. The use of synthetic plastic material enables the gutter screen to be manufactures in a one piece injection molding process and yields a relatively lightweight and inexpensive product. Alternatively, it is contemplated that the gutter screen may be constructed from aluminum or other metals or alloys to suit the user's aesthetic and/or durability needs. In at least one embodiment the gutter screen is thirty-six inches in length.

The gutter screen 10 preferably comprises two or more interlocking pieces that are matable and may be preferably installed onto a gutter. Looking to FIG. 1 the main body of the gutter screen preferably comprises a plurality of bars 12 that run generally in parallel with the gutter 1 when installed and a plurality of ribs 13 that cross, generally perpendicularly to the bars 12. Also spanning the ribs 13 is a roof flange 11 and an L-shaped gutter flange 14. The roof flange 11 preferably attaches the gutter screen 10 to the roof by fitting underneath a shingle located on the roof, while the gutter flange 14 attaches to gutter edge 2. The top surface of the roof flange 11 preferably comprises holes 19 covered in flash to hide the holes from view. The top surface of the roof flange 11 preferably is flush to the top section of each rib facilitating the flow of water from the roof, to the flange 11, onto the ribs 13 and into the gutter 1. Flange 10 may be equipped with an overlapping lip 18 which extends towards and connects with a second gutter screen. Thus the gutter screen 10, when installed, preferably has generally the same slope as the roof to facilitate flow of water into the gutter and debris over the edge of the gutter.

Preferably, the bars 12 and ribs 13 comprise a rounded top section 5 and a V-shaped bottom section 6 which serve to maximize flow of water from the top section 5 to the bottom section 6 and into the gutter 1. The rounded top design also serves to deflect debris away from the gutter and gutter guard. 9. Preferably, each bar is 4.0-5.0 mm wide and 7.5 mm high with a top radius of 2.5 mm; each rib 13 is 4.0-5.0 mm wide and 7.5 mm high with a top radius of 2.5 mm; and the apertures defined by the ribs and bars are 2.5 mm by 21 mm.

Looking now to an L-shaped gutter flange 14. Gutter flange 14 typically comprises a plurality of oval screw holes 30 mounted on and bored through the flange. Preferably, there are at least seven holes placed on the gutter flange to ensure the flange can be securely mounted to gutter 1 at gutter edge 2. The gutter flange 14 also preferably comprises a first slip joint 20 and a second slip joint 40. Slip joint 20 is preferably matable to slip joint 40 and slip joints 20 and 40 may be mirrored onto roof flange 11 in certain embodiments.

Figures 2, 3:
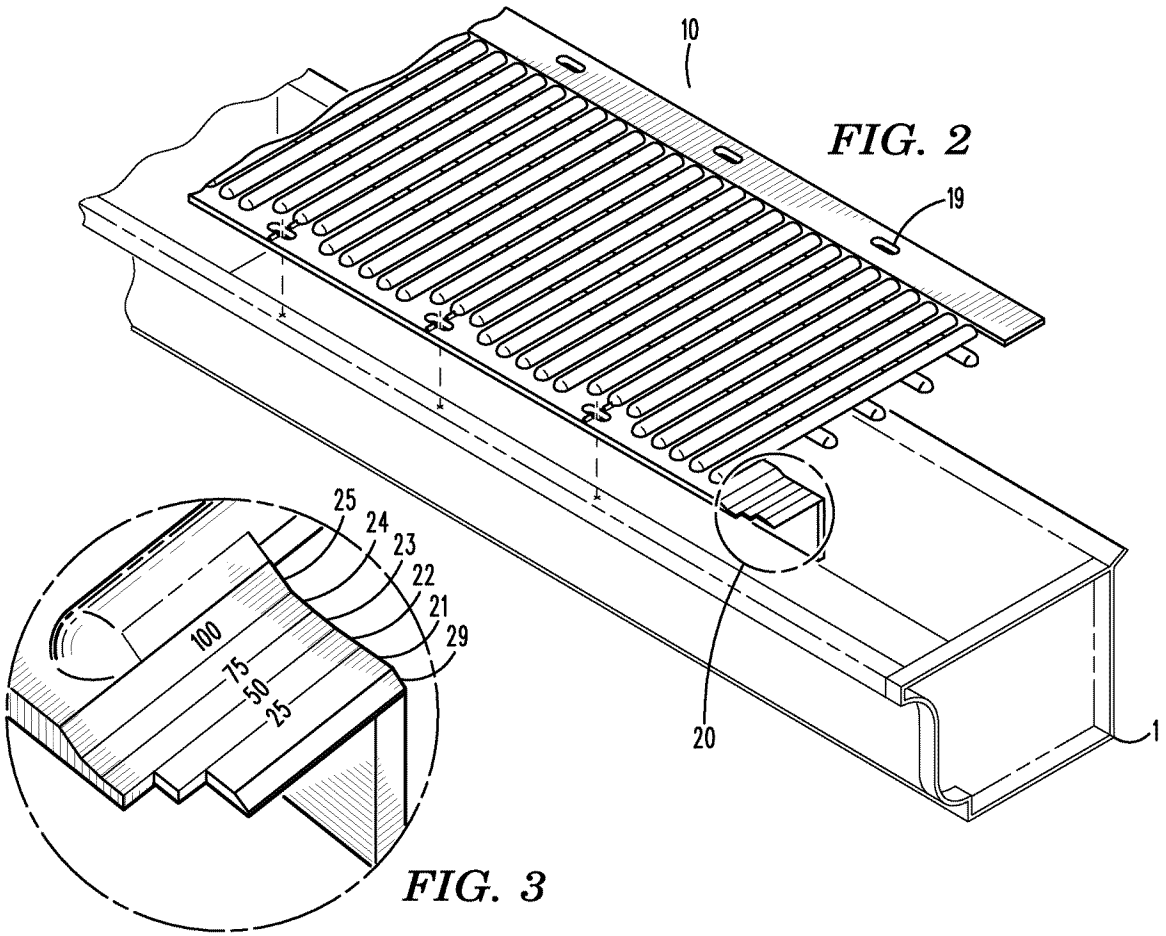
FIG. 2 is a perspective view of a preferred gutter screen or gutter guard assembly and gutter with attaching means.
FIG. 3 is a close up view of a preferred slip joint mating mechanism of FIG. 2.

Slip joint 20, shown with greater specificity in FIGS. 2, 3 is preferably a descending step-stair design. The joint has a beveled edge 29. Slip joint 20 is preferably matable with the second slip joint 40, shown with greater specificity in FIGS. 3, 7 which comprises at least an extended beveled edge 41. The slip joint is such that when pressure is applied the extended beveled edge 41 will ascend the step-stair, and when pressure is reduced the extended beveled edge will descend the step-stair. By way of example, beveled edge 41 may sit on first step 21, and when pressure is applied laterally to the combined joint, will ascend to a second step 22, third step 23, fourth step 24, and fifth step 25 depending on the pressure applied. Various embodiments of slip joint 20 are contemplated having fewer than or greater than five steps depending on the specificity needed for the installation needs of the user or facility on which screen 10 is installed. Preferably, each step or the space therebetween each step is labeled with a temperature indicator indicating to the user where the beveled edge 41 should be aligned on slip joint 20 during installation, based on the ambient temperature during installation. In one embodiment the steps are labeled using Fahrenheit (100°, 75°, 50°, 25°) and in a second embodiment they are labeled using Celsius. The specific temperatures and spacing necessary between steps are determined by the material properties of gutter screen 10, with particular emphasis to the thermal expansion coefficient $\alpha_L$ of the materials used in constructing the screen (e.g. plastic, aluminum) and the temperatures common in the installation climate.

Figure 4:
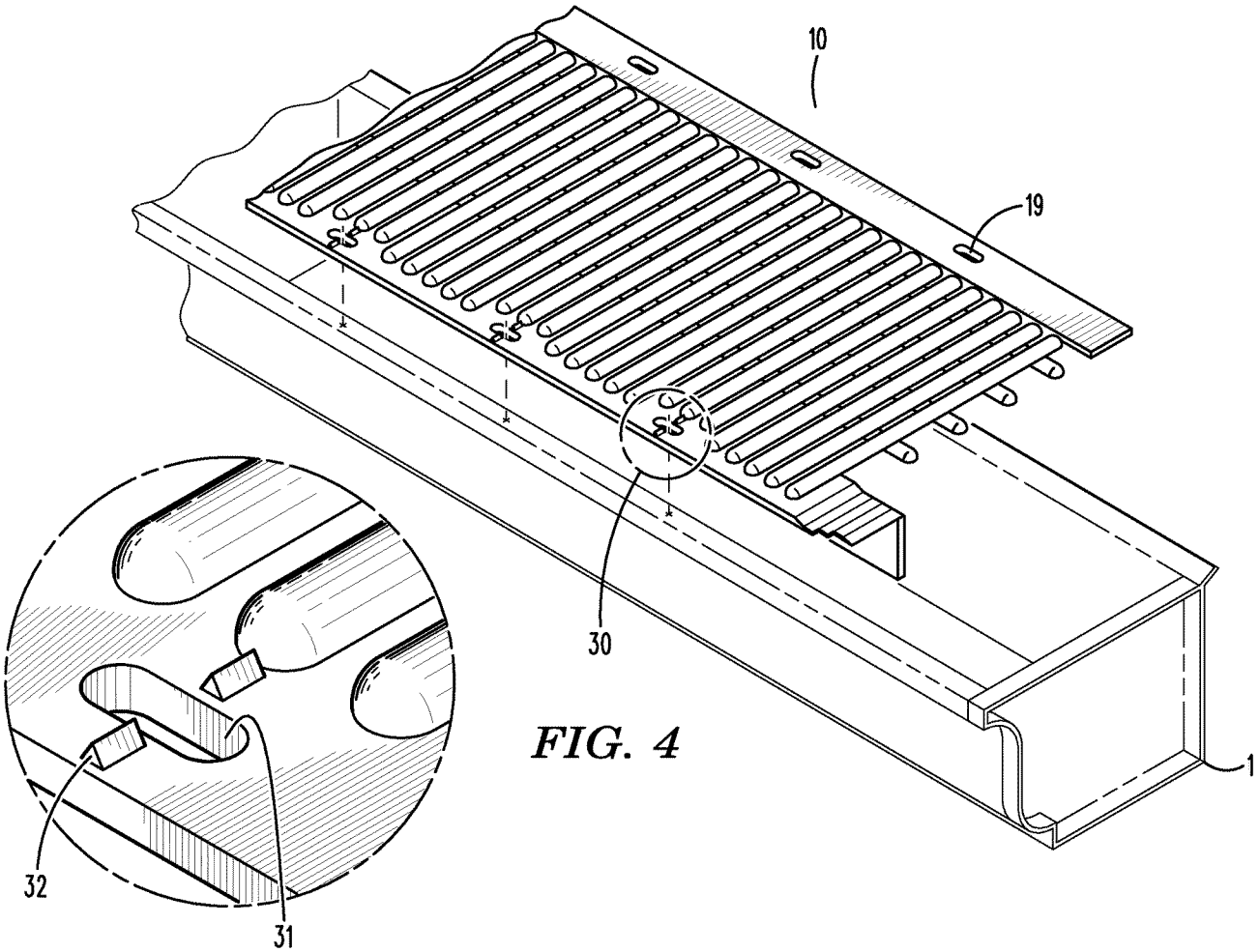
FIG. 4 is a perspective view of a preferred gutter screen and with close up view of a preferred connection apparatus for connection to the gutter.

Looking now to FIG. 4 screw holes 30 are shown with greater specificity. Holes 30 preferably comprise at least an oval hole 31 and a plurality of torque stops 32. Torque stops 32 preferably have an elongated pyramidal shape and are centered on a long edge of the oval screw holes. In a preferred embodiment, each oval hole 31 is flanked by two torque stops 32. The torque stops 32 operate as an indicator to the user to prevent a fastener from being overtightened into the screw hole 31. In operation, the toque stops, in combination with the oval shape of the screw holes allow the gutter screen 10 to be securely fastened to the gutter 1 along gutter edge 2, while also allowing lateral movement and expansion/contraction of gutter screen 10 without causing damage to or warping of the gutter 1. This increases performance of the gutter screen as a warped gutter screen or gutter will not carry water as well as, and will tend to become clogged more easily than a properly aligned gutter screen and gutter. Thus, the preferred screw holes 30, in combination with slip joints 20, 40 allow for installation of a gutter guard that will adapt to constant thermal expansion/contraction caused by changes to the ambient temperature without warping of the gutter guard or gutter.

Figure 5:
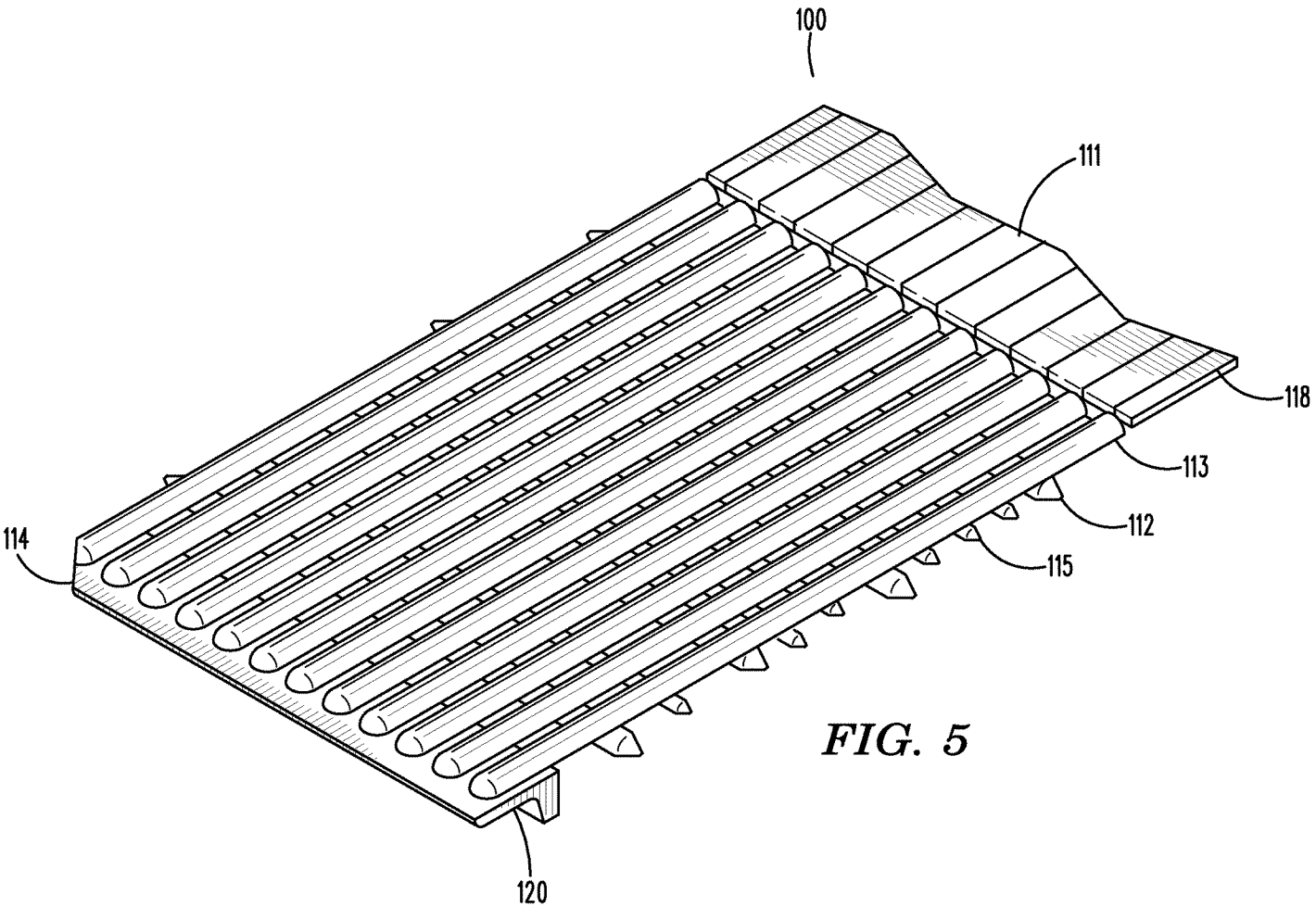
FIG. 5 is a perspective view of another preferred gutter screen for use in heavy debris environments.

FIG. 5 illustrates another preferred embodiment of a heavy debris gutter screen 100 contemplated in this invention. The heavy debris gutter screen 100, according to the present invention, preferably comprises a roof flange 111 for attaching the gutter screen 100 to a roof or similar structure, a plurality of bars 112 that run generally in parallel with the gutter 1 when installed, a plurality of ribs 113 that cross, generally perpendicularly to the bars 112, an L-shaped gutter flange 114, and a plurality of supplemental rods 115. The supplemental rods generally have a smaller width than the bars and are placed between the bars thus reducing the area of the apertures between the bars 112 to reduce the debris deposited within the gutter 1. In a preferred embodiment three supplemental rods are located between the first bar located nearest the roof flange and the second bar adjacent to the first bar; two supplemental rods are located between the second bar and the third bar being adjacent the second bar; and one supplemental rod is located between the third bar and a fourth bar located adjacent the gutter flange. This reduction of rods as you progress down the gutter screen 100 serves to reduce the amount of debris in the gutter, while also not severely impeding the flow of water into the gutter. The supplemental bars are preferably 2.5 mm in width. Heavy debris gutter 100 is preferably equipped with slip joint 120 being similar in operation to slip joints described elsewhere within this specification, and may preferably be equipped with other preferred amenities described herein.

Figure 7:
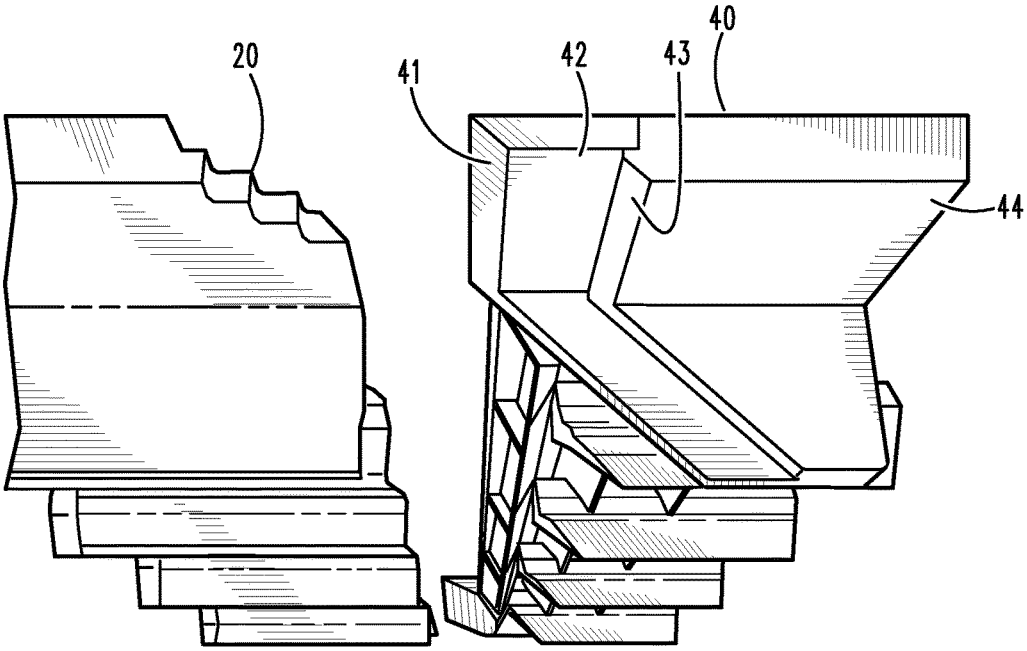
FIG. 7. is a bottom perspective view of a preferred gutter screen or gutter guard assembly and gutter with attaching means.

Looking now to FIG. 7 slip joint 40 is shown with greater specificity. Slip joint 40 is matable with slip joint 20 preferably at beveled edge 41. Adjacent edge 41 is preferably a horizontal surface 42, which serves to provide space for edge 41 to climb joint 20 when pressure is applied in a horizontal direction. A second beveled edge 43 is located at the opposite end of flat surface 42 and is matable with beveled edges on slip joint 20. This will provide additional protection against warping due to thermal expansion in the event of improper installation, or unanticipated conditions. A second horizontal surface 44 abuts edge 43 which traverses to the main body of gutter screen 10.

In accordance with the previous descriptions, an installer preferably would find proper installation of the preferred gutter screen 10 to be greatly simplified compared to previously invented gutter screens. Thus a method of installing a gutter screen 10 is contemplated. The method comprising at least the steps of providing a plurality of gutter screen 10 portions, positioning a first gutter screen portion above a gutter 1, the gutter 1 mounted to the side of a building and having a gutter edge 2, the roof flange 11 positioned nearest the building and the gutter flange 14 positioned nearest the gutter edge2, positioning a second gutter screen portion 10 adjacent to the first gutter screen portion, mating the first slip joint 20 of the first gutter screen portion to the second slip joint 40 of the second gutter screen portion and thereby assembling a gutter screen.

Preferably the method of installation may also have the steps of obtaining a reading of the ambient temperature during installation of the gutter screen, and mating the first slip joint 20 of the first gutter screen portion to the second slip joint 40 of the second gutter screen portion by aligning the extended beveled edge of the second slip joint with the step of the first slip joint having the temperature indicator closest to the reading of the ambient temperature. The method may preferably also include the steps of securing the gutter flange 14 to the gutter edge 2 by providing a plurality of fasteners, inserting the fasteners through the oval screw holes 31, boring the fastener into the gutter edge 2, and tightening the fastener until the fastener is in contact with the torque stop 32. And may also utilize the step of positioning the roof flange 11 underneath at least one roof shingle.

Accordingly, although the invention has been described by reference to certain preferred and alternative embodiments, it is not intended that the novel arrangements be limited thereby, but that modifications thereof are intended to be included as falling within the broad scope and spirit of the foregoing disclosures and the appended drawings.

BACKGROUND OF THE INVENTION

Field of the Invention

The present invention generally relates to an improved gutter guard assembly and joints. More particularly, the present invention relates a screen-type gutter guard with interlocking joints designed to control and account for thermal expansion of the gutter guard during cold and/or hot weather.

Discussion of the Prior Art

U.S. Pat. No. 6,164,020 ('020 Patent), which issued to Nitch, discloses a Roof Gutter Guard. The '020 Patent describes a gutter screen for preventing the accumulation of debris within a gutter is disclosed. The gutter screen has a plurality of ribs positioned to run transversely across the gutter. Each rib has a rounded first top section, the first top section having a top surface emanating circumferentially about the first top section, a V-shaped first bottom section, a first end, and a second end. The gutter screen also has a plurality of bars positioned to ran above and generally parallel to the gutter. The bars have a rounded second top section and a V-shaped second bottom section. The second top section of each bar is attached to and interconnects the first bottom sections of each rib, the ribs and the bars defining a plurality of gutter screen apertures. A roof flange for attaching the gutter screen underneath a roof shingle extends from the first end of each rib. The roof flange has a roof flange surface which is flush with the top surface of the rib. A L-shaped gutter flange for engaging a gutter edge extends transversely and interconnectingly across each rib just below the first top section at the second end of each rib.

U.S. Pat. No. 6,951,077 ('077 Patent), which issued to Higginbotham, discloses a Non Clogging Screen. The '077 Patent essentially describes an improved gutter shield device includes a first connecting plane of roll formed metal, a second filtering plane of roll formed metal and metallic or polymer cloth, and a third connecting plane of roll formed metal combined into an integral unit. An elongated strip of roll formed metal includes a rear vertical plane adapted to seat beneath shingles of a roof structure. The rear vertical plane is crimped by roll forming onto the second and rear longitudinal edge of a forward extending plane that combines a fine filtering membrane with an underlying skeletal support of expanded metal as an integral unit. The expanded metal and filtering membrane so joined contain two or more v-shaped downward extending longitudinal channels within the forward extending plane that transverse the length of the forward extending plane parallel to it's first edge. The forward extending plane is bound on a first and forward longitudinal edge by a first plane of that comprises a roll formed angled z-shaped connecting metal strip for securing the gutter shield to an inwardly extending flange of a k-style gutter.

U.S. Pat. No. 7,056,433 ('433 Patent), which issued to Swistun, discloses a Gutter Screen Termination Trim with Water Tension Breaker. The '433 Patent describes a gutter screen attachment for minimizing water film runoff and debris collection adjacent a screened gutter. The screen attachment comprises a superior breaker edge, an inferior breaker edge, and a screen-receiving region. The screen-receiving region comprises an edge-receiving fold that accepts the gutter-engaging edge of a gutter screen. The superior breaker edge extends upwardly opposite the inferior breaker edge and is designed to break the water tension of a water film formed upon the gutter screen. The inferior breaker edge is designed to prevent water leakage between the screen attachment and the gutter. The superior breaker edge is of minimized height so as to allow bulky debris to translate over the superior breaker edge. It is thus contemplated that the superior breaker edge functions to allow water to more properly permeate through the gutter screen.

United States Patent Application No. 2005/0028452, which was authored by Brochu, describes a device for protecting a gutter having a rear wall, front wall and a bottom wall, the walls defining a trough there between, the device comprising a guard member having generally planar central portion with one side thereof having an inverted U-shaped configuration designed to fit over an upper marginal edge of the rear wall of the gutter while at the other side, there is provided an overflow wall. The guard and gutter are attached directly to a supporting structure by means of screws or other mechanical fastening devices.

United States Patent Application No. 2013/0061537, which was authored by Hawes, relates to an apparatus that prevents rain gutters for clogging and, more particularly, a gutter guard.

United States Patent Application No. 2015/0033638, which was authored by Davis, describes gutter guard apparatuses and methods of making the same are provided. A gutter guard apparatus for preventing debris from entering rainwater collection gutters on a structure. A gutter guard apparatus can comprise a guard panel and mesh layer that cooperate to prevent debris from entering a rainwater collection gutter. The mesh layer can be secured to the guard panel at substantially all points of contact between the mesh layer and guard panel to thereby provide a secure and durable gutter guard apparatus. Methods and devices for forming a gutter guard can comprise bonding the mesh layer to a guard panel using a radiant heater, heated roller, adhesive applicator, ultrasonic welder and/or combinations thereof.

SUMMARY OF THE INVENTION

Gutter screens have been previously used in order to prevent the accumulation of leaves, sticks, and other debris in a gutter while allowing for the flow of rainwater into the gutter. However, the prior art gutter screens routinely encounter the problems of allowing too much debris into the gutter and/or allowing too little water into the gutter (often known as spillover). In addition, prior art screens become ineffective over time as they are unable to prevent accumulation of leaves and debris in the gutter screen thus losing efficacy and resulting in increased, unwanted, spillover. Accordingly, it is an object of this invention to provide a gutter screen that minimizes the amount of debris that will clog the gutters and the gutter screen itself thus maximizing desired water flow into the gutter.

In addition, gutters and gutter screens have routinely encountered the problem of thermal expansion. Previously, gutter screens have been installed end-to-end by aligning them on top of the gutter, typically heavily relying on the expertise of the installer. However, ambient temperature changes affect the expansion/contraction of the gutter screen material after installation of the screen. Therefore, during cooler weather the guards need spacing between each section or they will bind and warp as temperatures rise and fluctuate. Conversely, if gutter screens are installed during hotter weather, the contraction of the material will result in significant gaps between the guards resulting in significant debris entering, and eventually clogging the gutter, significantly impeding the intended purpose of the gutter guard. Accordingly it is an object of this invention to provide a gutter screen capable of being installed at any temperature, minimize installation error, simplify the installation process, and minimize damage to the gutters caused by negligent installation of gutter screens.

To achieve these objectives, a gutter screen for compensating for thermal expansion and/or contraction and preventing the accumulation of debris within a gutter is proposed.

In one embodiment the invention considers a gutter screen having at least a plurality of bars positioned to run above and generally parallel to a gutter, each bar having a rounded top section and a V-shaped bottom section, a plurality of ribs positioned to run transversely across and above the gutter, each having a first end and a second end; each rib having a rounded top section and a V-shaped bottom section, the ribs positioned on top of the bars to define a plurality of apertures for water penetration therein, a roof flange for attaching the gutter screen to a roof, the roof flange extending laterally from the first end of each rib, interconnecting each rib, the roof flange having a top surface flush to the top section of each rib, an L-shaped gutter flange for engaged a gutter edge, the gutter flange extending laterally from the second end of each rib, interconnecting each rib, a plurality of oval screw holes located on the gutter flange, a first slip joint located at a first end of the gutter screen, a second slip joint located at a second end of the gutter screen and matable to the first slip joint, the first slip joint being a descending step-stair design, each step having a beveled edge, the second slip joint being an extended beveled edge, the beveled edge matable to each of the beveled edges each step of the first slip joint such that when pressure is applied the extended beveled edge will ascend the step-stair, and when pressure is reduced the extended beveled edge will descend the step-stair. The step stairs may preferably be equipped with visual indicators indicating the proper way to install the gutter screen at various temperatures.

In another embodiment, the invention considers a gutter screen having at least a plurality of bars positioned to run above and generally parallel to a gutter, a plurality of ribs positioned to run transversely across and above the gutter, the ribs positioned on top of the bars to define a plurality of apertures for water penetration therein, a first end of the plurality of ribs positioned nearest an edge of a roof, a first slip joint located at a first end of the gutter screen, a second slip joint located at a second end of the gutter screen and matable to the first slip joint, the first slip joint being a descending step-stair design, each step having a beveled edge, and the second slip joint being an extended beveled edge, the beveled edge matable to each of the beveled edges each step of the first slip joint such that when pressure is applied the extended beveled edge will ascend the step-stair, and when pressure is reduced the extended beveled edge will descend the step-stair. The embodiment may preferably be capable of accounting for thermal expansion of the gutter screen material.

In another embodiment, the invention considers a method of installing a gutter screen the method having at least the steps of providing a plurality of gutter screen portions, said gutter screen portions comprising a plurality of bars positioned to run above and generally parallel to a gutter, a plurality of ribs having a first end and a second end positioned to run transversely across and above the gutter, the ribs positioned on top of the bars to define a plurality of apertures for water penetration therein, a first slip joint located at a first end of the gutter screen, a second slip joint located at a second end of the gutter screen and matable to the first slip joint, the first slip joint being a descending step-stair design, each step having a beveled edge, the second slip joint being an extended beveled edge, the beveled edge matable to each of the beveled edges each step of the first slip joint such that when pressure is applied the extended beveled edge will ascend the step-stair, and when pressure is reduced the extended beveled edge will descend the step-stair, a roof flange for attaching the gutter screen to a roof, the roof flange extending laterally from the first end of each rib, interconnecting each rib, the roof flange having a top surface flush to the top section of each rib, and an L-shaped gutter flange for engaged a gutter edge, the gutter flange extending laterally from the second end of each rib, interconnecting each rib, positioning a first gutter screen portion above a gutter, the gutter mounted to the side of a building and having a gutter edge; the roof flange positioned nearest the building and the gutter flange positioned nearest the gutter edge, positioning a second gutter screen portion adjacent to the first gutter screen portion, mating the first slip joint of the first gutter screen portion to the second slip joint of the second gutter screen portion and thereby assembling the gutter screen.

The aforementioned method may be further modified and specifically include at least the steps of obtaining a reading of the ambient temperature during installation of the gutter screen, wherein each step of the first slip joint is labeled with a temperature indicator, and wherein mating the first slip joint of the first gutter screen portion to the second slip joint of the second gutter screen portion comprises aligning the extended beveled edge of the second slip joint with the step of the first slip joint having the temperature indicator closest to the reading of the ambient temperature.

Such embodiments do not represent the full scope of the invention. Reference is made therefore to the claims herein for interpreting the full scope of the invention. Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of the following brief descriptions of drawings:

FIG. 1 is a perspective view of a preferred gutter screen or gutter guard assembly and gutter.

FIG. 2 is a perspective view of a preferred gutter screen or gutter guard assembly and gutter with attaching means.

FIG. 3 is a close up view of a preferred slip joint mating mechanism of FIG. 2.

FIG. 4 is a perspective view of a preferred gutter screen and with close up view of a preferred connection apparatus for connection to the gutter.

FIG. 5 is a perspective view of another preferred gutter screen for use in heavy debris environments.

Figure 6:
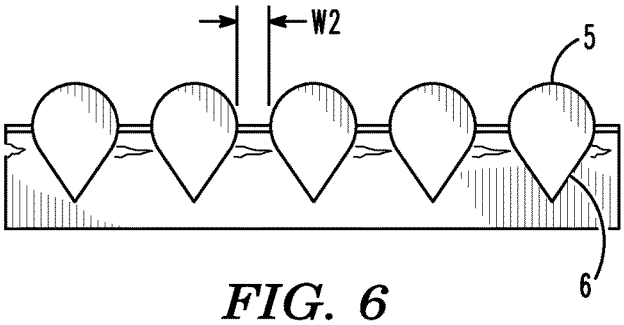
FIG. 6 is a cross-sectional view of a preferred gutter screen or gutter guard assembly and gutter with attaching means.

FIG. 6 is a cross-sectional view of a preferred gutter screen or gutter guard assembly and gutter with attaching means.

FIG. 7. is a bottom perspective view of a preferred gutter screen or gutter guard assembly and gutter with attaching means.

DETAILED DESCRIPTION OF THE PREFERRED EMBODIMENT

Referring now the drawings with more specificity, the present invention essentially provides a gutter screen or gutter guard as at 10 which is preferably formed as a three dimensional construction and that can be easily constructed and deconstructed by hand or other similar means and is mountable on a commercial or residential gutter 1. The gutter screen 10, according to the present invention, preferably comprises a roof flange 11 for attaching the gutter screen 10 to a roof or similar structure, a plurality of bars 12 that run generally in parallel with the gutter 1 when installed, a plurality of ribs 13 that cross, generally perpendicularly to the bars 12, and an L-shaped gutter flange 14.

The gutter screen 10 is preferably constructed from any number of moldable flexible synthetic plastic material. Such moldable materials may be provided with select coloration to comport with the user's needs. The use of synthetic plastic material enables the gutter screen to be manufactures in a one piece injection molding process and yields a relatively lightweight and inexpensive product. Alternatively, it is contemplated that the gutter screen may be constructed from aluminum or other metals or alloys to suit the user's aesthetic and/or durability needs. In at least one embodiment the gutter screen is thirty-six inches in length.

The gutter screen 10 preferably comprises two or more interlocking pieces that are matable and may be preferably installed onto a gutter. Looking to FIG. 1 the main body of the gutter screen preferably comprises a plurality of bars 12 that run generally in parallel with the gutter 1 when installed and a plurality of ribs 13 that cross, generally perpendicularly to the bars 12. Also spanning the ribs 13 is a roof flange 11 and an L-shaped gutter flange 14. The roof flange 11 preferably attaches the gutter screen 10 to the roof by fitting underneath a shingle located on the roof, while the gutter flange 14 attaches to gutter edge 2. The top surface of the roof flange 11 preferably comprises holes 19 covered in flash to hide the holes from view. The top surface of the roof flange 11 preferably is flush to the top section of each rib facilitating the flow of water from the roof, to the flange 11, onto the ribs 13 and into the gutter 1. Flange 10 may be equipped with an overlapping lip 18 which extends towards and connects with a second gutter screen. Thus the gutter screen 10, when installed, preferably has generally the same slope as the roof to facilitate flow of water into the gutter and debris over the edge of the gutter.

Preferably, the bars 12 and ribs 13 comprise a rounded top section 5 and a V-shaped bottom section 6 which serve to maximize flow of water from the top section 5 to the bottom section 6 and into the gutter 1. The rounded top design also serves to deflect debris away from the gutter and gutter guard. 9. Preferably, each bar is 4.0-5.0 mm wide and 7.5 mm high with a top radius of 2.5 mm; each rib 13 is 4.0-5.0 mm wide and 7.5 mm high with a top radius of 2.5 mm; and the apertures defined by the ribs and bars are 2.5 mm by 21 mm.

Looking now to an L-shaped gutter flange 14. Gutter flange 14 typically comprises a plurality of oval screw holes 30 mounted on and bored through the flange. Preferably, there are at least seven holes placed on the gutter flange to ensure the flange can be securely mounted to gutter 1 at gutter edge 2. The gutter flange 14 also preferably comprises a first slip joint 20 and a second slip joint 40. Slip joint 20 is preferably matable to slip joint 40 and slip joints 20 and 40 may be mirrored onto roof flange 11 in certain embodiments.

Slip joint 20, shown with greater specificity in FIGS. 2, 3 is preferably a descending step-stair design. The joint has a beveled edge 29. Slip joint 20 is preferably matable with the second slip joint 40, shown with greater specificity in FIGS. 3, 7 which comprises at least an extended beveled edge 41. The slip joint is such that when pressure is applied the extended beveled edge 41 will ascend the step-stair, and when pressure is reduced the extended beveled edge will descend the step-stair. By way of example, beveled edge 41 may sit on first step 21, and when pressure is applied laterally to the combined joint, will ascend to a second step 22, third step 23, fourth step 24, and fifth step 25 depending on the pressure applied. Various embodiments of slip joint 20 are contemplated having fewer than or greater than five steps depending on the specificity needed for the installation needs of the user or facility on which screen 10 is installed. Preferably, each step or the space therebetween each step is labeled with a temperature indicator indicating to the user where the beveled edge 41 should be aligned on slip joint 20 during installation, based on the ambient temperature during installation. In one embodiment the steps are labeled using Fahrenheit (100°, 75°, 50°, 25°) and in a second embodiment they are labeled using Celsius. The specific temperatures and spacing necessary between steps are determined by the material properties of gutter screen 10, with particular emphasis to the thermal expansion coefficient $\alpha_L$ of the materials used in constructing the screen (e.g. plastic, aluminum) and the temperatures common in the installation climate.

Looking now to FIG. 4 screw holes 30 are shown with greater specificity. Holes 30 preferably comprise at least an oval hole 31 and a plurality of torque stops 32. Torque stops 32 preferably have an elongated pyramidal shape and are centered on a long edge of the oval screw holes. In a preferred embodiment, each oval hole 31 is flanked by two torque stops 32. The torque stops 32 operate as an indicator to the user to prevent a fastener from being overtightened into the screw hole 31. In operation, the toque stops, in combination with the oval shape of the screw holes allow the gutter screen 10 to be securely fastened to the gutter 1 along gutter edge 2, while also allowing lateral movement and expansion/contraction of gutter screen 10 without causing damage to or warping of the gutter 1. This increases performance of the gutter screen as a warped gutter screen or gutter will not carry water as well as, and will tend to become clogged more easily than a properly aligned gutter screen and gutter. Thus, the preferred screw holes 30, in combination with slip joints 20, 40 allow for installation of a gutter guard that will adapt to constant thermal expansion/contraction caused by changes to the ambient temperature without warping of the gutter guard or gutter.

FIG. 5 illustrates another preferred embodiment of a heavy debris gutter screen 100 contemplated in this invention. The heavy debris gutter screen 100, according to the present invention, preferably comprises a roof flange 111 for attaching the gutter screen 100 to a roof or similar structure, a plurality of bars 112 that run generally in parallel with the gutter 1 when installed, a plurality of ribs 113 that cross, generally perpendicularly to the bars 112, an L-shaped gutter flange 114, and a plurality of supplemental rods 115. The supplemental rods generally have a smaller width than the bars and are placed between the bars thus reducing the area of the apertures between the bars 112 to reduce the debris deposited within the gutter 1. In a preferred embodiment three supplemental rods are located between the first bar located nearest the roof flange and the second bar adjacent to the first bar; two supplemental rods are located between the second bar and the third bar being adjacent the second bar; and one supplemental rod is located between the third bar and a fourth bar located adjacent the gutter flange. This reduction of rods as you progress down the gutter screen 100 serves to reduce the amount of debris in the gutter, while also not severely impeding the flow of water into the gutter. The supplemental bars are preferably 2.5 mm in width. Heavy debris gutter 100 is preferably equipped with slip joint 120 being similar in operation to slip joints described elsewhere within this specification, and may preferably be equipped with other preferred amenities described herein.

Looking now to FIG. 7 slip joint 40 is shown with greater specificity. Slip joint 40 is matable with slip joint 20 preferably at beveled edge 41. Adjacent edge 41 is preferably a horizontal surface 42, which serves to provide space for edge 41 to climb joint 20 when pressure is applied in a horizontal direction. A second beveled edge 43 is located at the opposite end of flat surface 42 and is matable with beveled edges on slip joint 20. This will provide additional protection against warping due to thermal expansion in the event of improper installation, or unanticipated conditions. A second horizontal surface 44 abuts edge 43 which traverses to the main body of gutter screen 10.

In accordance with the previous descriptions, an installer preferably would find proper installation of the preferred gutter screen 10 to be greatly simplified compared to previously invented gutter screens. Thus a method of installing a gutter screen 10 is contemplated. The method comprising at least the steps of providing a plurality of gutter screen 10 portions, positioning a first gutter screen portion above a gutter 1, the gutter 1 mounted to the side of a building and having a gutter edge 2, the roof flange 11 positioned nearest the building and the gutter flange 14 positioned nearest the gutter edge2, positioning a second gutter screen portion 10 adjacent to the first gutter screen portion, mating the first slip joint 20 of the first gutter screen portion to the second slip joint 40 of the second gutter screen portion and thereby assembling a gutter screen.

Preferably the method of installation may also have the steps of obtaining a reading of the ambient temperature during installation of the gutter screen, and mating the first slip joint 20 of the first gutter screen portion to the second slip joint 40 of the second gutter screen portion by aligning the extended beveled edge of the second slip joint with the step of the first slip joint having the temperature indicator closest to the reading of the ambient temperature. The method may preferably also include the steps of securing the gutter flange 14 to the gutter edge 2 by providing a plurality of fasteners, inserting the fasteners through the oval screw holes 31, boring the fastener into the gutter edge 2, and tightening the fastener until the fastener is in contact with the torque stop 32. And may also utilize the step of positioning the roof flange 11 underneath at least one roof shingle.

Accordingly, although the invention has been described by reference to certain preferred and alternative embodiments, it is not intended that the novel arrangements be limited thereby, but that modifications thereof are intended to be included as falling within the broad scope and spirit of the foregoing disclosures and the appended drawings.

I claim:

1. A gutter screen comprising:

a plurality of bars positioned to run above and generally parallel to a gutter, each bar having a rounded top section and a V-shaped bottom section;

a plurality of ribs positioned to run transversely across and above the gutter, each having a first end and a second end; each rib having a rounded top section and a V-shaped bottom section, the ribs positioned on top of the bars to define a plurality of apertures for water penetration therein;

a roof flange for attaching the gutter screen to a roof, the roof flange extending laterally from the first end of each rib, interconnecting each rib, the roof flange having a top surface flush to the top section of each rib;

an L-shaped gutter flange for engaging a gutter edge, the gutter flange extending laterally from the second end of each rib, interconnecting each rib;

a plurality of oval screw holes located on the gutter flange;

a first slip joint located at a first end of the gutter screen;

a second slip joint located at a second end of the gutter screen and mateable to a first slip joint of an adjacent gutter screen;

each first slip joint being a descending step-stair design comprising a plurality of steps; and the second slip joint being an extended beveled edge, the beveled edge mateable to each step of the first slip joint of the adjacent screen such that when pressure is applied the extended beveled edge will ascend the step-stair of the adjacent screen, and when pressure is removed the extended beveled edge will descend the step-stair of the adjacent screen.

2. The gutter screen of claim 1 wherein each step is labeled with a temperature indicator.

3. The gutter screen of claim 2 wherein:

the first slip joint comprises a first portion and a second portion, the first portion located at the first end of the rib located at the first end of the gutter screen, the second portion located at the second end of the rib located at the first end of the gutter screen; and the second slip joint comprises a first portion and a second portion, the first portion located at the first end of the rib located at the second end of the gutter screen, the second portion located at the second end of the rib located at the second end of the gutter screen.

4. The gutter screen of claim 1 further comprising:

a plurality of torque stops having an elongated pyramidal shape;

each of the torque stops centered on a long edge of the oval screw holes; wherein a fastener having a fastener head may be inserted through the oval screw hole and may be tightened until the fastener head is in contact with the torque stop thereby indicating to an installer to cease tightening the fastener.

5. The gutter screen of claim 4 wherein:

two of said plurality of torque stops are located at each long edge of each oval screw hole.

6. The gutter screen of claim 1 further comprising:

a plurality of supplemental rods positioned to run above and generally parallel to the gutter and the bars;

the supplemental rods having a smaller width than the bars; and the supplemental rods spaced therebetween the bars thus reducing the area of the plurality of apertures.

7. The gutter screen of claim 6 wherein:

three supplemental rods of said plurality of supplemental rods are located between a first bar of said plurality of bars located nearest the roof flange and a second bar of said plurality of bars being adjacent to the first bar;

two supplemental rods of said plurality of supplemental rods are located between the second bar and a third bar of said plurality of bars being adjacent the second bar; and one supplemental rod of said plurality of supplemental rods is located between the third bar and a fourth bar of said plurality of bars located adjacent the gutter flange.

8. The gutter screen of claim 6 wherein:

the supplemental rods are 2.5 mm in width.

9. The gutter screen of claim 1 wherein:

each rib is 4.0 to 5.0 mm wide and 7.5 mm high with a top radius of 2.5 mm;

each bar is 4.0 to 5.0 mm wide and 7.5 mm high with a top radius of 2.5 mm;

the apertures defined by the ribs and bars are 2.5 mm by 21 mm;

there are at least seven holes placed on the gutter flange; and the gutter screen is 36 inches in length.

10. The gutter screen of claim 1 wherein the gutter screen is made of a synthetic plastic material and is of a molded single piece construction.

11. A gutter screen comprising:

a plurality of bars positioned to run above and generally parallel to a gutter;

a plurality of ribs positioned to run transversely across and above the gutter, the ribs positioned on top of the bars to define a plurality of apertures for water penetration therein;

a first end of the plurality of ribs positioned nearest an edge of a roof;

a first slip joint located at a first end of the gutter screen;

a second slip joint located at a second end of the gutter screen and mateable to a first slip joint of an adjacent gutter screen;

each first slip joint being a descending step-stair design comprising a plurality of steps;

the second slip joint being an extended beveled edge, the beveled edge mateable to each step of the first slip joint of the adjacent screen such that when pressure is applied the extended beveled edge will ascend the step-stair of the adjacent screen, and when pressure is removed the extended beveled edge will descend the step-stair of the adjacent screen;

an L-shaped gutter flange for engaging a gutter edge, the gutter flange extending laterally from a second end of each rib, interconnecting each rib;

a plurality of oval screw holes located on the gutter flange;

a plurality of torque stops having an elongated pyramidal shape;

each of the torque stops centered on a long edge of the oval screw holes; wherein a fastener having a fastener head may be inserted through one of the oval screw holes and may be tightened until the fastener head is in contact with at least one of the torque stops thereby indicating to an installer to cease tightening the fastener.

12. The gutter screen of claim 11 wherein:

each bar of said plurality of bars comprises a rounded top section and a V-shaped bottom section.

13. The gutter screen of claim 11 wherein:

each rib of said plurality of ribs comprises a rounded top section and a V-shaped bottom section.

14. The gutter screen of claim 11 wherein:

two of said plurality of torque stops are located at each long edge of each oval screw hole.

15. The gutter screen of claim 11 further comprising:

a roof flange for attaching the gutter screen to a roof, the roof flange extending laterally from the first end of each rib, interconnecting each rib, the roof flange having a top surface flush with each rib.

16. The gutter screen of claim 11 wherein:

each step on the first slip joint is labeled with a temperature indicator.

17. The gutter screen of claim 16 wherein:

the first slip joint comprises at least four steps.

18. A method of installing a gutter screen comprising:

providing a plurality of gutter screen portions;

said gutter screen portions each comprising a plurality of bars positioned to run above and generally parallel to a gutter, a plurality of ribs having a first end and a second end positioned to run transversely across and above the gutter, the ribs positioned on top of the bars to define a plurality of apertures for water penetration therein, a first slip joint located at a first end of each of the gutter screen portions, a second slip joint located at a second end of each of the gutter screen portions and mateable to the first slip joint of an adjacent gutter screen portion of said plurality of gutter screen portions, the first slip joint being a descending step-stair design comprising a plurality of steps, the second slip joint being an extended beveled edge, the beveled edge mateable to each step of the first slip joint of said adjacent gutter screen portion such that when pressure is applied the extended beveled edge will ascend the step-stair of said adjacent gutter screen portion, and when pressure is removed the extended beveled edge will descend the step-stair of said adjacent gutter screen portion, a roof flange for attaching each gutter screen portion to a roof, the roof flange extending laterally from the first end of each rib, interconnecting each rib, the roof flange having a top surface flush to the top section of each rib, and an L-shaped gutter flange for engaging a gutter edge of the gutter, the gutter flange extending laterally from the second end of each rib, interconnecting each rib;

positioning a first gutter screen portion of said plurality of gutter screen portions above the gutter, the gutter mounted to a side of a building; the roof flange of said first gutter screen portion positioned nearest the building and the gutter flange of said first gutter screen portion positioned nearest the gutter edge;

positioning a second gutter screen portion of said plurality of gutter screen portions adjacent to the first gutter screen portion;

mating the first slip joint of the first gutter screen portion to the second slip joint of the second gutter screen portion; thereby assembling the gutter screen.

19. The method installing a gutter screen of claim 18 further comprising:

obtaining a reading of the ambient temperature during installation of the gutter screen;

wherein each step of the first slip joint of the first gutter screen portion is labeled with a temperature indicator; and wherein mating the first slip joint of the first gutter screen portion to the second slip joint of the second gutter screen portion comprises aligning the extended beveled edge of the second slip joint of the second gutter screen portion with the step of the first slip joint of the first gutter screen portion having the temperature indicator closest to the reading of the ambient temperature.

20. The method installing a gutter screen of claim 19 further comprising:

securing the gutter flange of each of the first and second gutter screen portions to the gutter edge;

wherein the gutter flange of each of the first and second gutter screen portions further comprises a plurality of oval holes, a plurality of torque stops having an elongated pyramidal shape centered on a long edge of the oval screw holes; and wherein securing the gutter flange of each of the first and second gutter screen portions to the gutter edge comprises: providing a plurality of fasteners, inserting the fasteners through the oval screw holes, boring the fasteners into the gutter edge, and tightening the fasteners until the fasteners are in contact with the torque stops.

21. The method of installing a gutter screen of claim 17 further comprising:

positioning the roof flange of each of the first and second gutter screen portions underneath at least one roof shingle.

* * * * *